US008777820B2

(12) United States Patent
Lo

(10) Patent No.: US 8,777,820 B2
(45) Date of Patent: Jul. 15, 2014

(54) ADJUSTABLE WEIGHT ASSSEMBLY FOR WEIGHT TRAINING MACHINE

(76) Inventor: Chiu-Hsiang Lo, Taichung (TW)

( * ) Notice: Subject to any disclaimer, the term of this patent is extended or adjusted under 35 U.S.C. 154(b) by 258 days.

(21) Appl. No.: 13/455,151

(22) Filed: Apr. 25, 2012

(65) Prior Publication Data

US 2013/0237390 A1 Sep. 12, 2013

(30) Foreign Application Priority Data

Mar. 6, 2012 (TW) ..... 101107511 A

(51) Int. Cl.
*A63B 21/062* (2006.01)

(52) U.S. Cl.
USPC ..... 482/98

(58) Field of Classification Search
USPC ..... 482/98, 92–94, 97, 99, 4, 5, 107, 482/100–103, 133, 135–137, 908
See application file for complete search history.

(56) References Cited

U.S. PATENT DOCUMENTS

| | | | | |
|---|---|---|---|---|
| 5,306,221 | A * | 4/1994 | Itaru | 482/98 |
| 5,350,344 | A * | 9/1994 | Kissel | 482/98 |
| 5,616,107 | A * | 4/1997 | Simonson | 482/97 |
| 7,413,532 | B1 * | 8/2008 | Monsrud et al. | 482/99 |
| 7,485,076 | B2 * | 2/2009 | Lee | 482/99 |
| 7,815,554 | B2 * | 10/2010 | Gibson et al. | 482/98 |
| 8,192,334 | B2 * | 6/2012 | Sela | 482/98 |
| 2004/0009854 | A1 * | 1/2004 | Shiang et al. | 482/93 |

* cited by examiner

*Primary Examiner* — Oren Ginsberg
*Assistant Examiner* — Megan Anderson

(57) ABSTRACT

An adjustable weight assembly includes a weight device and an adjustment device. The weight device includes a rail, a movable member and multiple weights. The movable member is connected to a rod and receives a force applied by a force applying unit so as to move along the rail. The rod has multiple through holes and each weight has a latitude hole and a longitudinal hole. Each latitude hole has a pin extending therethrough and the rod extends through the longitudinal holes. The adjustable device includes a driving unit, a movable part and multiple pivotal members. The driving unit drives the movable part and each weight is pivotably connected to one of the pivotal members. When the movable part moves along the rail, the pivotal member is pivoted to decide the engagement between the pin and the through hole so that the user can adjust the number of the weights.

11 Claims, 14 Drawing Sheets

ADJUSTABLE WEIGHT ASSSEMBLY FOR WEIGHT TRAINING MACHINE

FIELD OF THE INVENTION

The present invention relates to an adjustable weight assembly, and more particularly, to an adjustable weight assembly for a weight training machine.

BACKGROUND OF THE INVENTION

The conventional weight training machine provides proper number of weights to train the user's muscles by repeatedly lifting and lowering the weights. U.S. Pat. No. 6,551,223, U.S. Pat. No. 6,974,405 and U.S. Pat. No. 7,011,609 disclose a weight training machine which is has a rail on a base, and a movable member and multiple weights are movably installed to the rail. The movable member is connected to a rod and a force applying unit. The rod extends through the weights and has multiple holes. The weight is positioned by extending a pin through one of the holes. The user applies a force to the force applying device to move the movable member and the weights to achieve the purpose of training. However, the prior arts do not have linked pins to automatically choose the number of the weights so that the user has to insert the pins one by one when positioning the weights, and this requires time. Besides, the conventional weight training machines do not have satisfied adjustable weight device for the user to adjust the weight as desired.

SUMMARY OF THE INVENTION

The present invention relates to an adjustable weight assembly and comprises a weight device and an adjustment device. The weight device includes a rail, a movable member and multiple weights. The movable member is connected to a rod and receives a force applied by a force applying unit so as to move along the rail. The rod has multiple through holes and each weight has a latitude hole and a longitudinal hole. Each latitude hole has a pin extending therethrough and the rod extends through the longitudinal holes. The adjustable device includes a driving unit, a movable part and multiple pivotal members. The driving unit drives the movable part and each weight is pivotably connected to one of the pivotal members. When the movable part moves along the rail, the pivotal member is pivoted to decide the engagement between the pin and the through hole so that the user can adjust the number of the weights.

Another embodiment of the present invention provides two weight devices and two adjustment devices, wherein a connection member is connected between the two respective movable members of the two weight devices. One weight of the weight device is lighter than the weight of the other weight device so that the lighter weight is used to adjust the total load when using the weight training machine.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
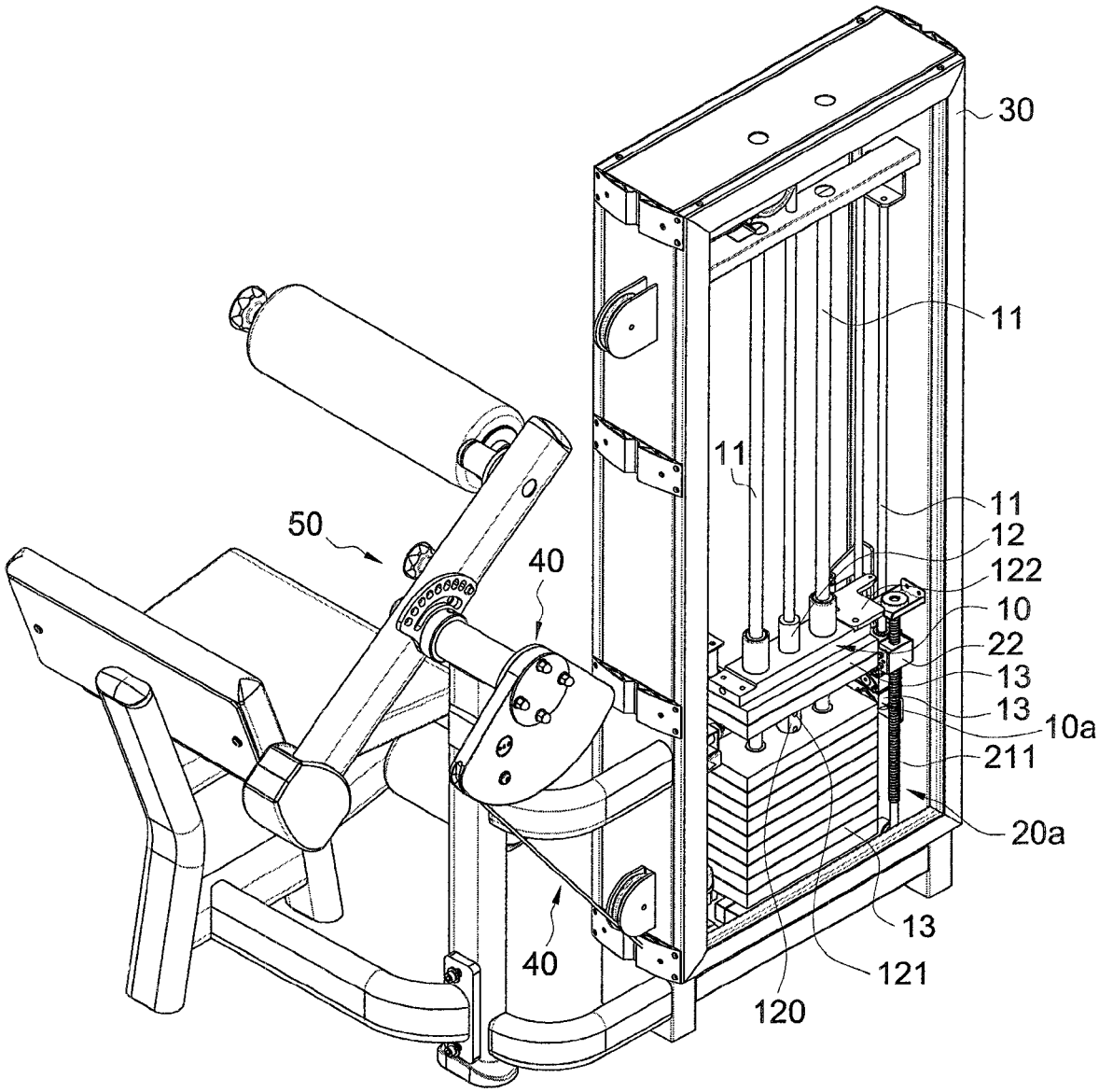
FIG. 1 is a perspective view to show the adjustable weight assembly of the present invention is installed to a weight training machine.
Figure 2:
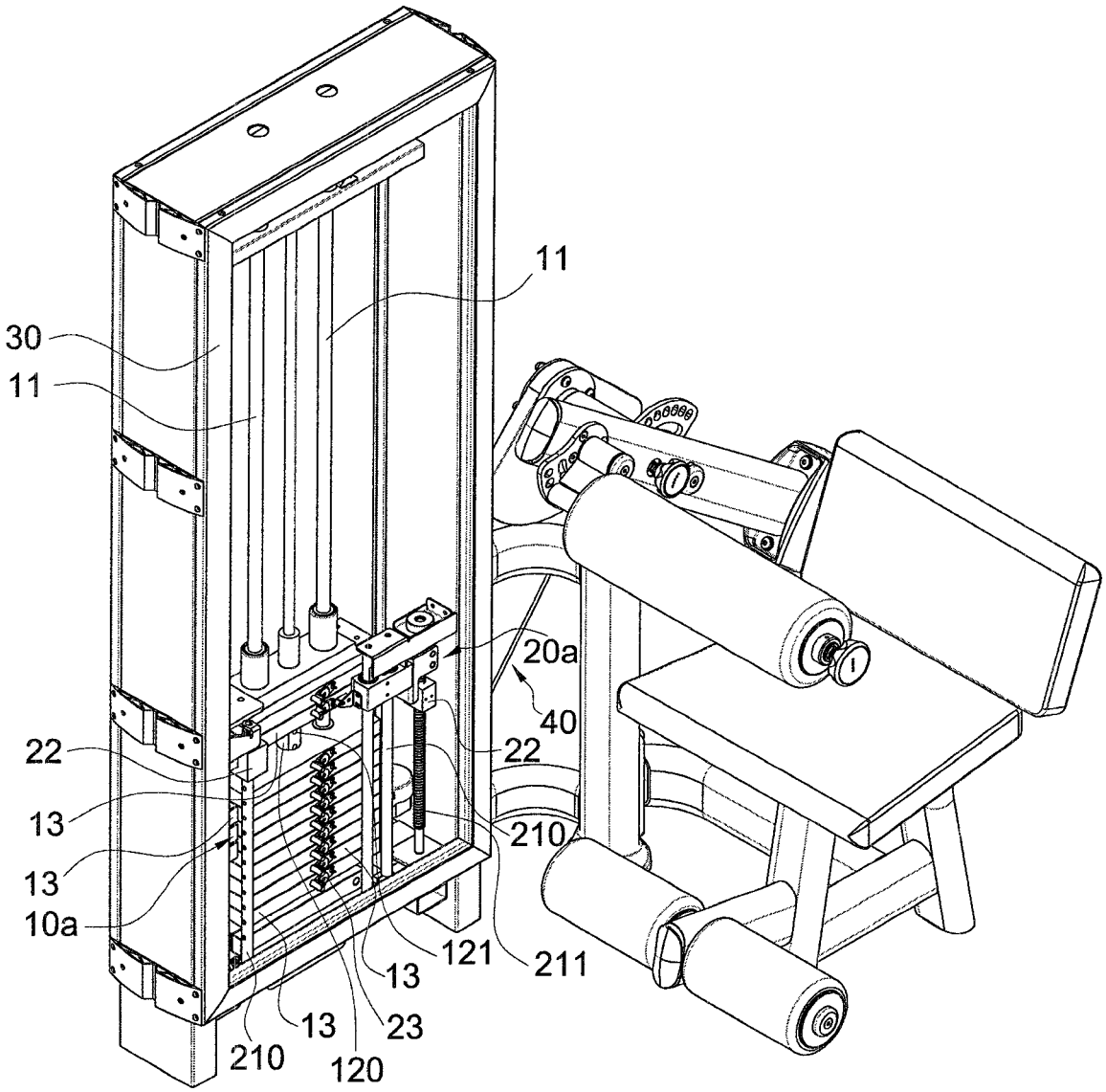
FIG. 2 is another perspective view to show the adjustable weight assembly of the present invention is installed to the weight training machine.
Figure 3:
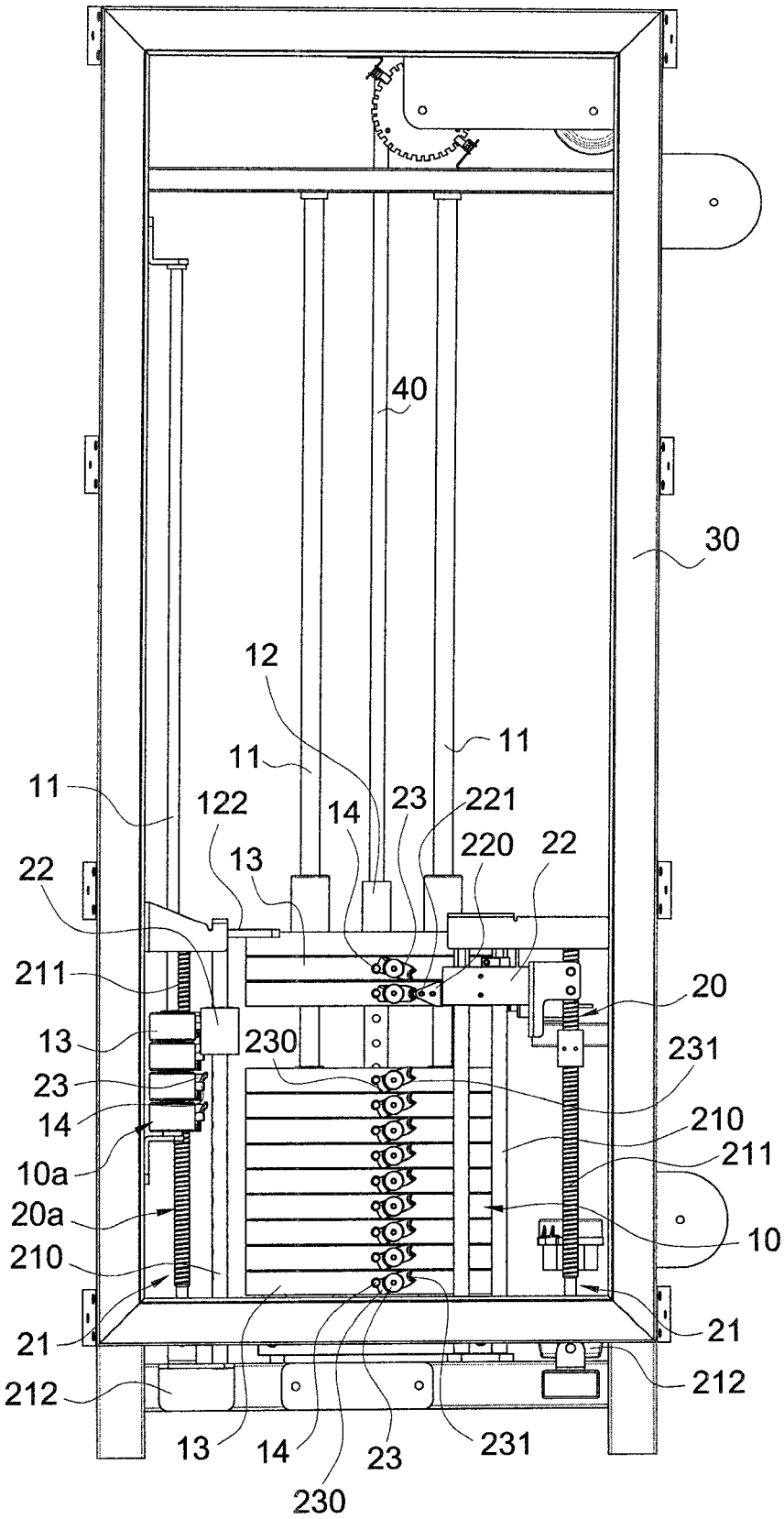
FIG. 3 is a plane view to show that two weights of the adjustable weight assembly of the present invention are lifted.
Figure 4:
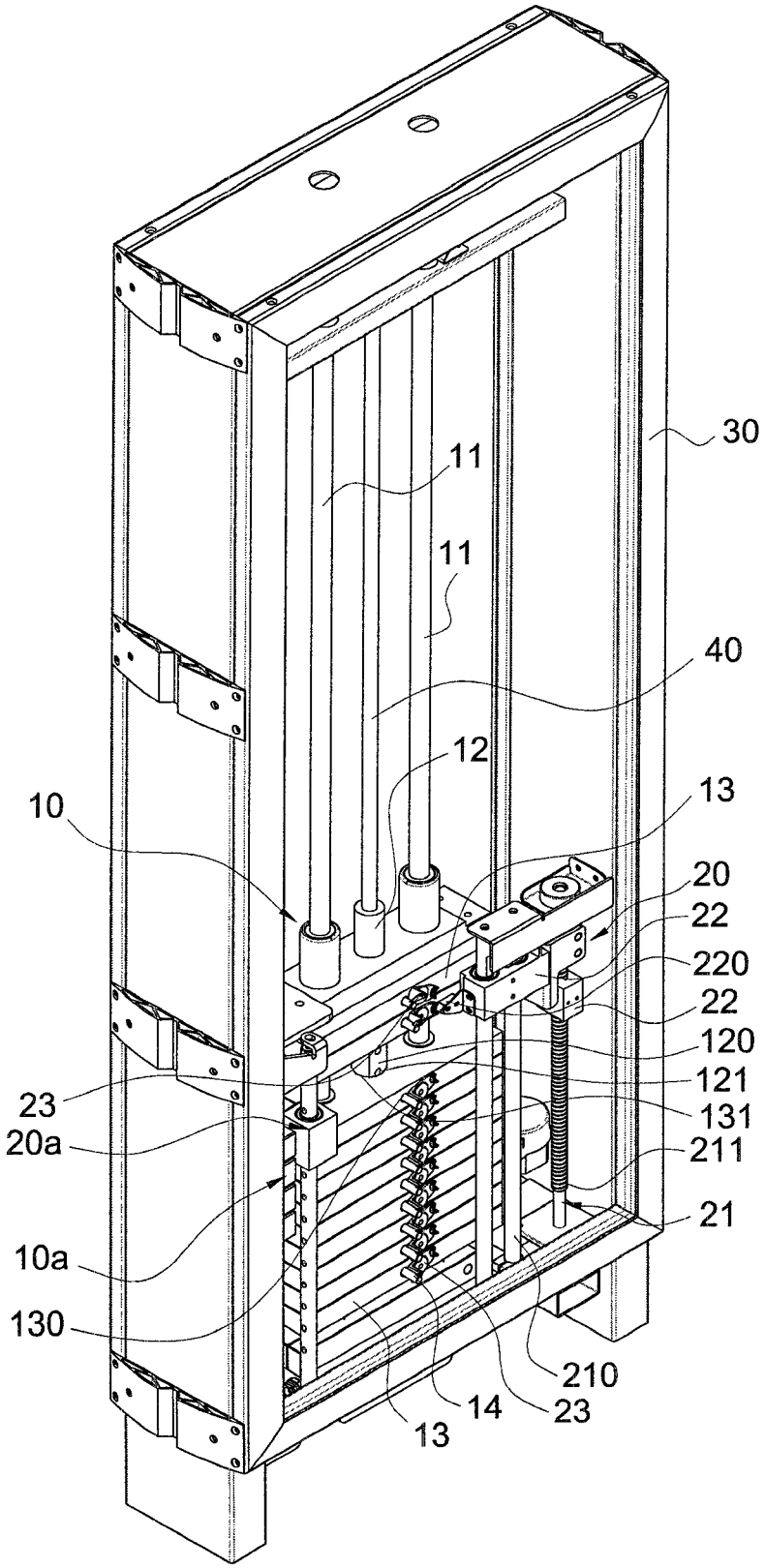
FIG. 4 is a perspective view to show that two weights of the adjustable weight assembly of the present invention are lifted.
Figure 5:
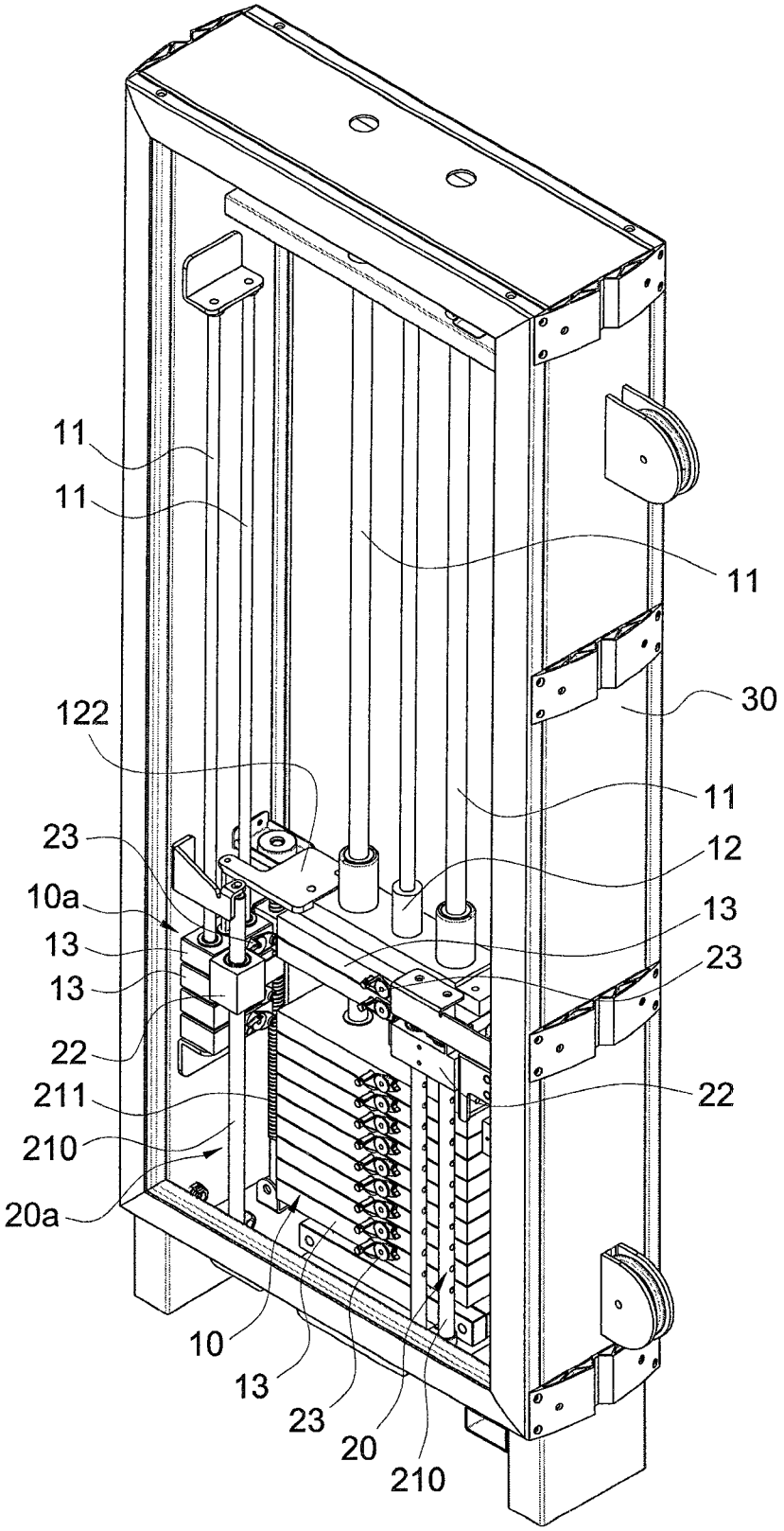
FIG. 5 is another view of the disclosure in FIG. 4.
Figure 6:
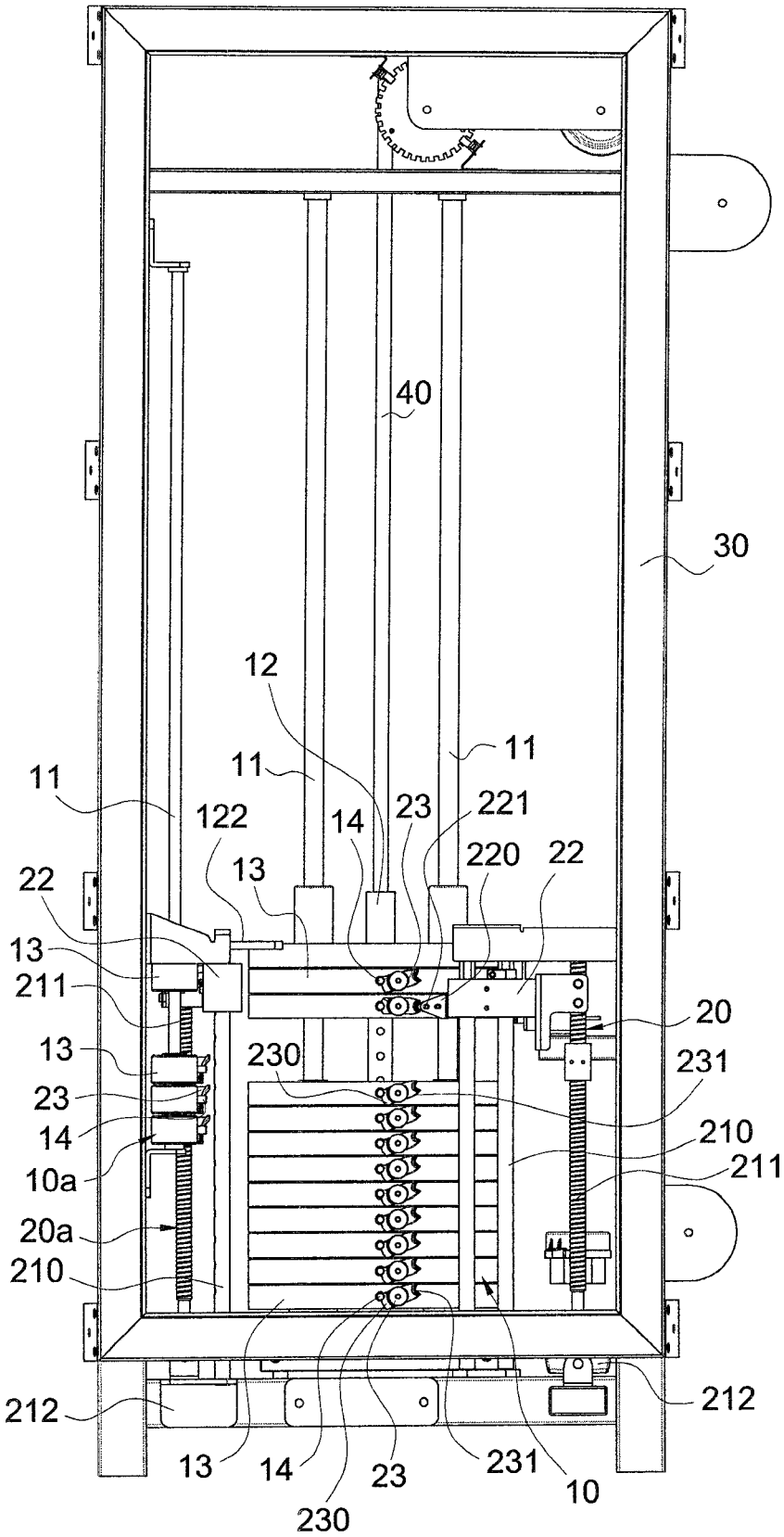
FIG. 6 is a plane view to show that one large weight and one small weight of the adjustable weight assembly of the present invention are lifted.
Figure 10:
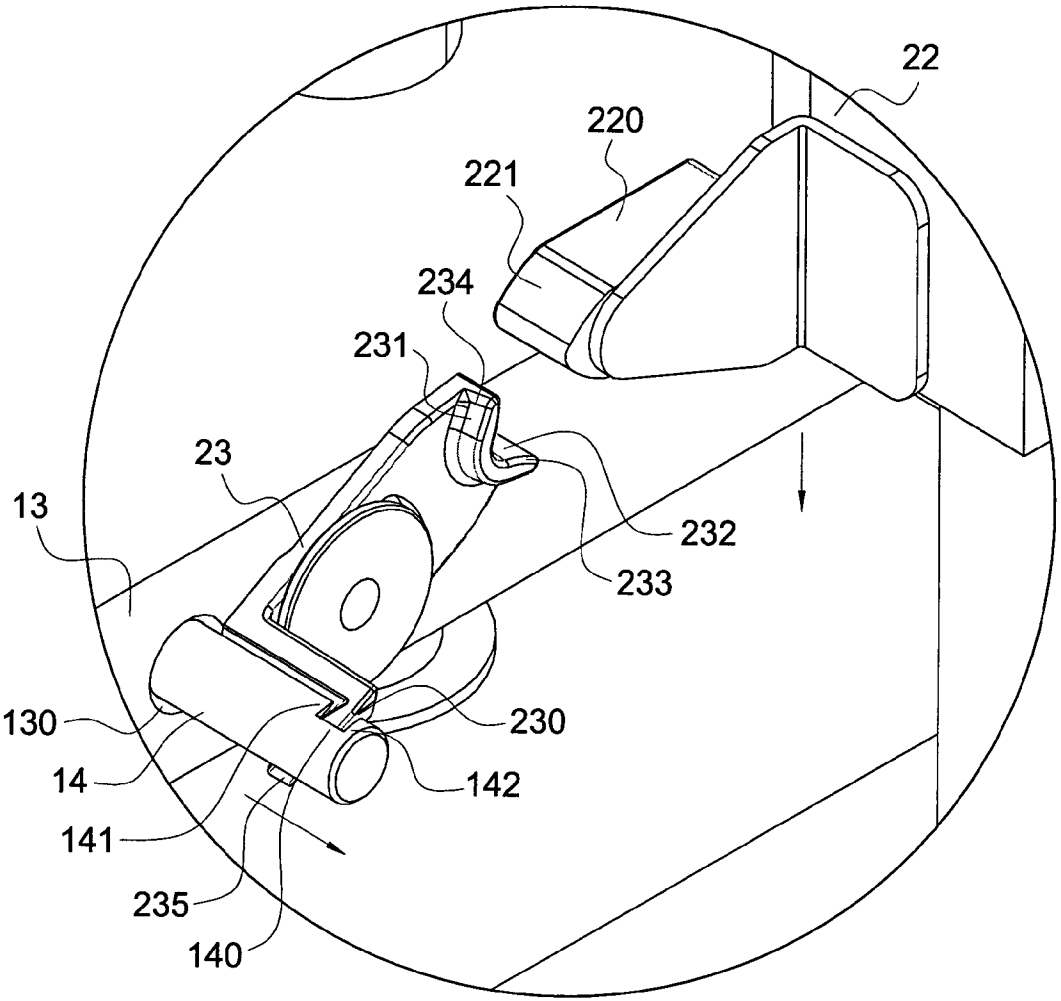
FIG. 10 is a partial perspective view of the connection of the weight device and the adjustment device of the present invention.
Figure 11:
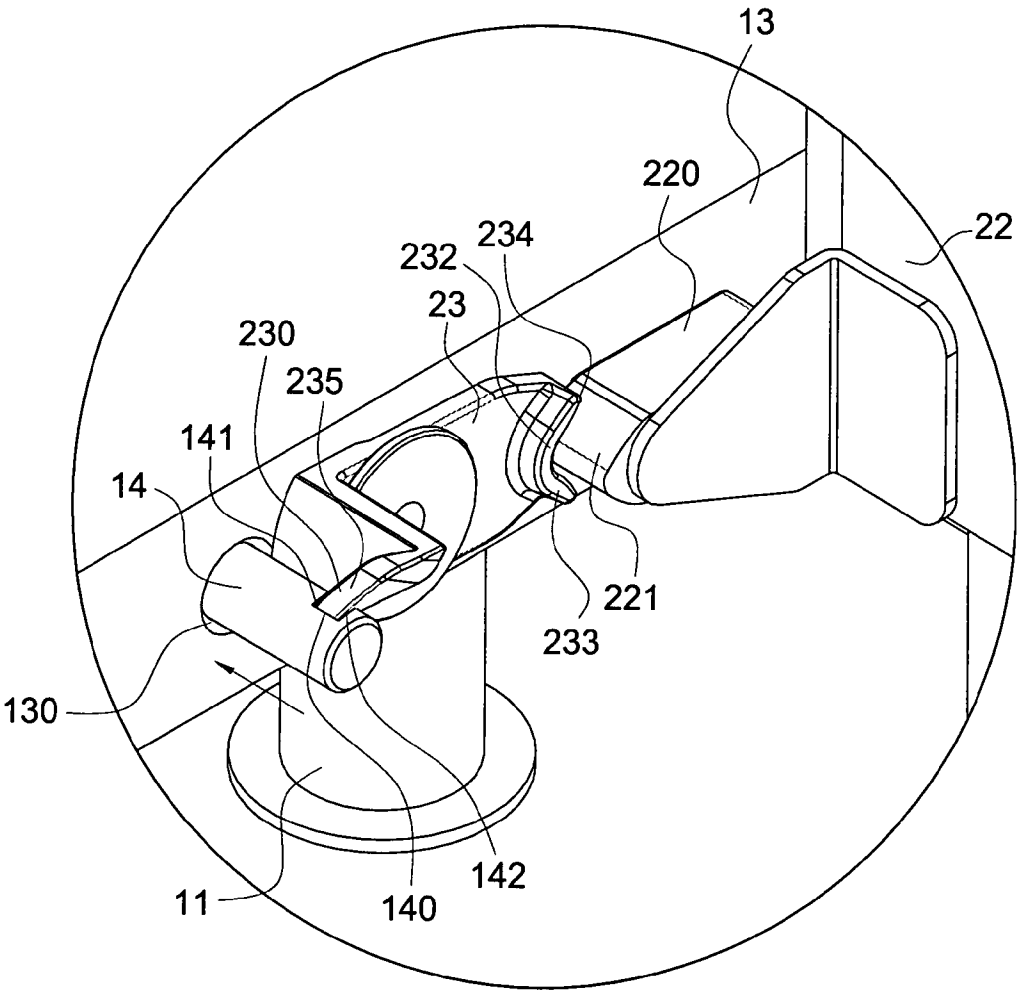
FIG. 11 is a partial perspective view to show the action between the weight device and the adjustment device of the present invention.
Figure 12:
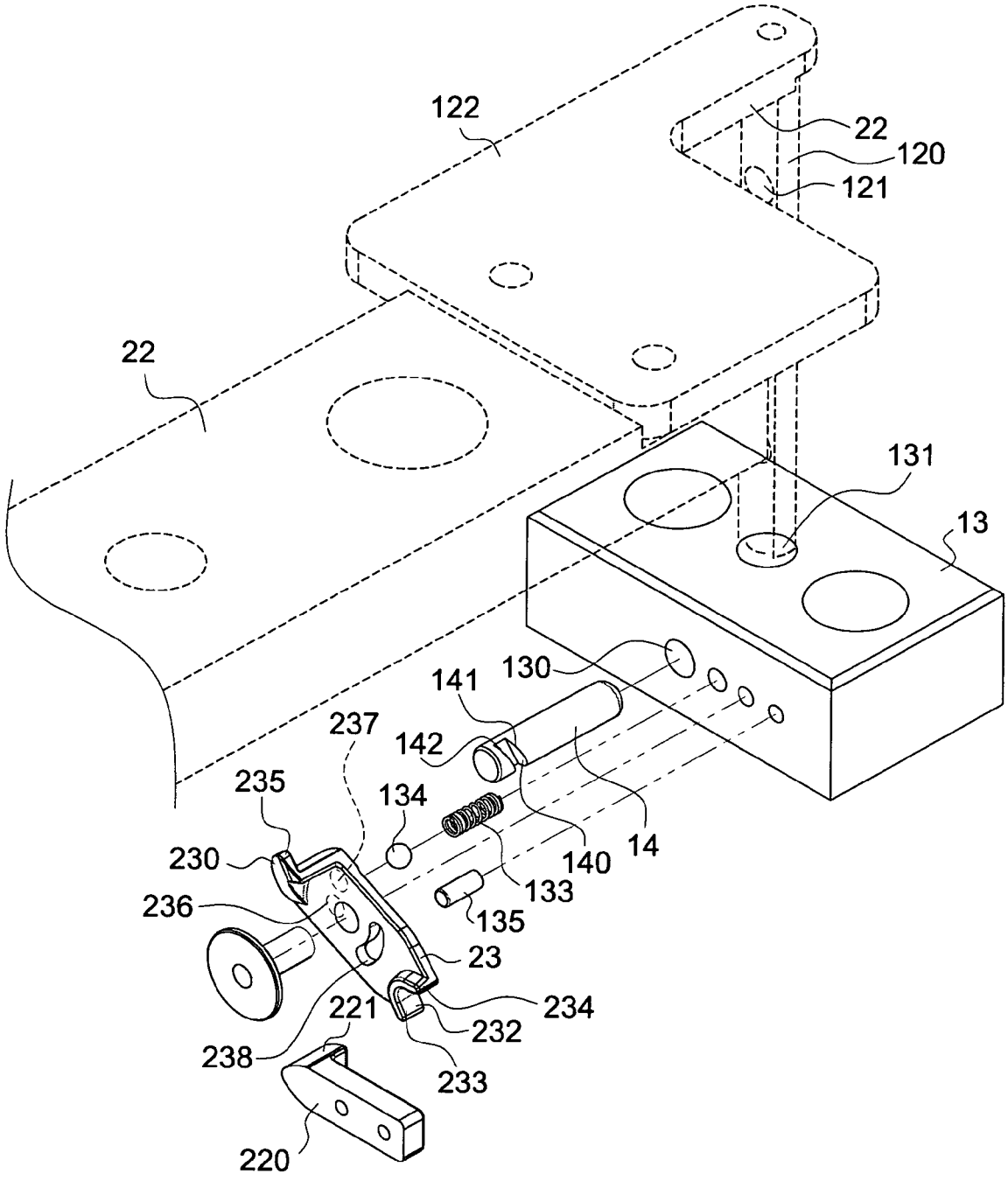
FIG. 12 is a partial exploded view to show the other weight device and the other adjustment device of the present invention.
Figure 13:
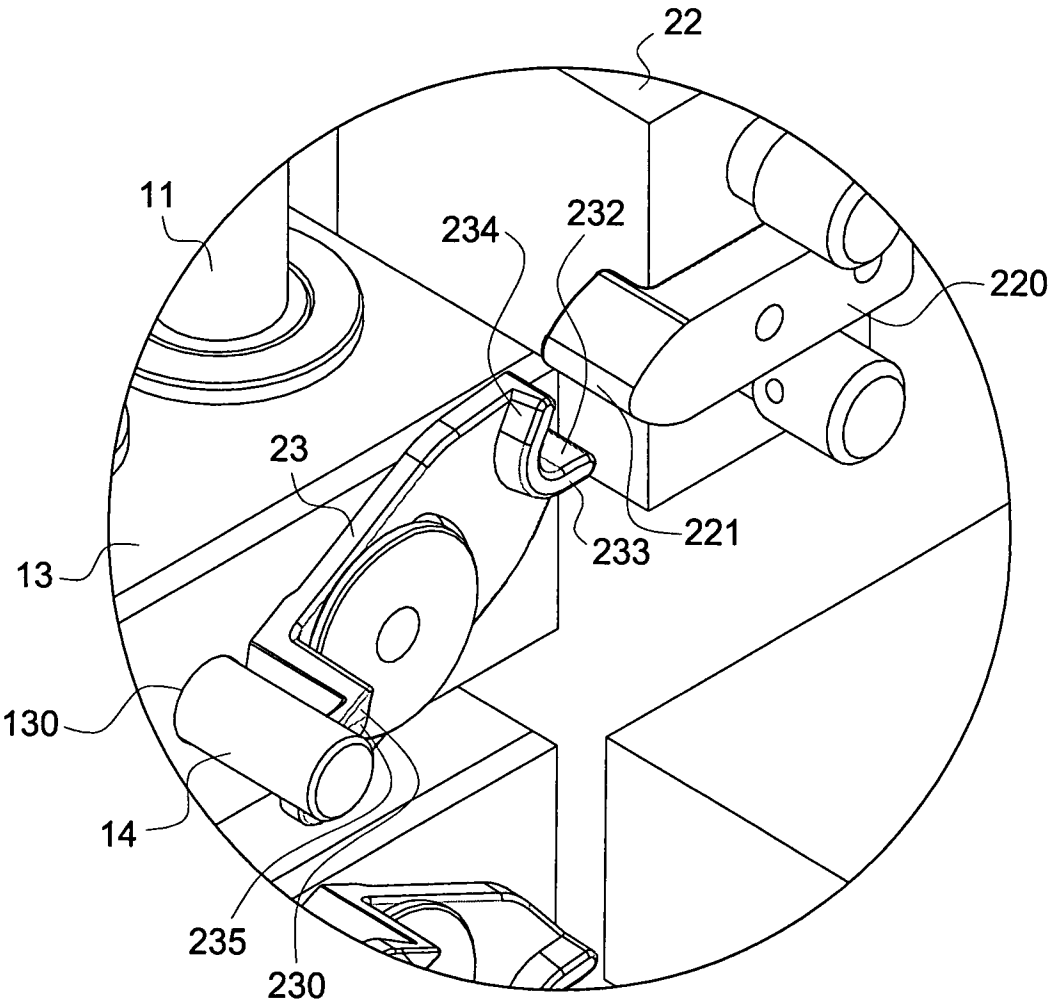
FIG. 13 is a partial perspective view of the connection of the weight device and the adjustment device in FIG. 12.
Figure 14:
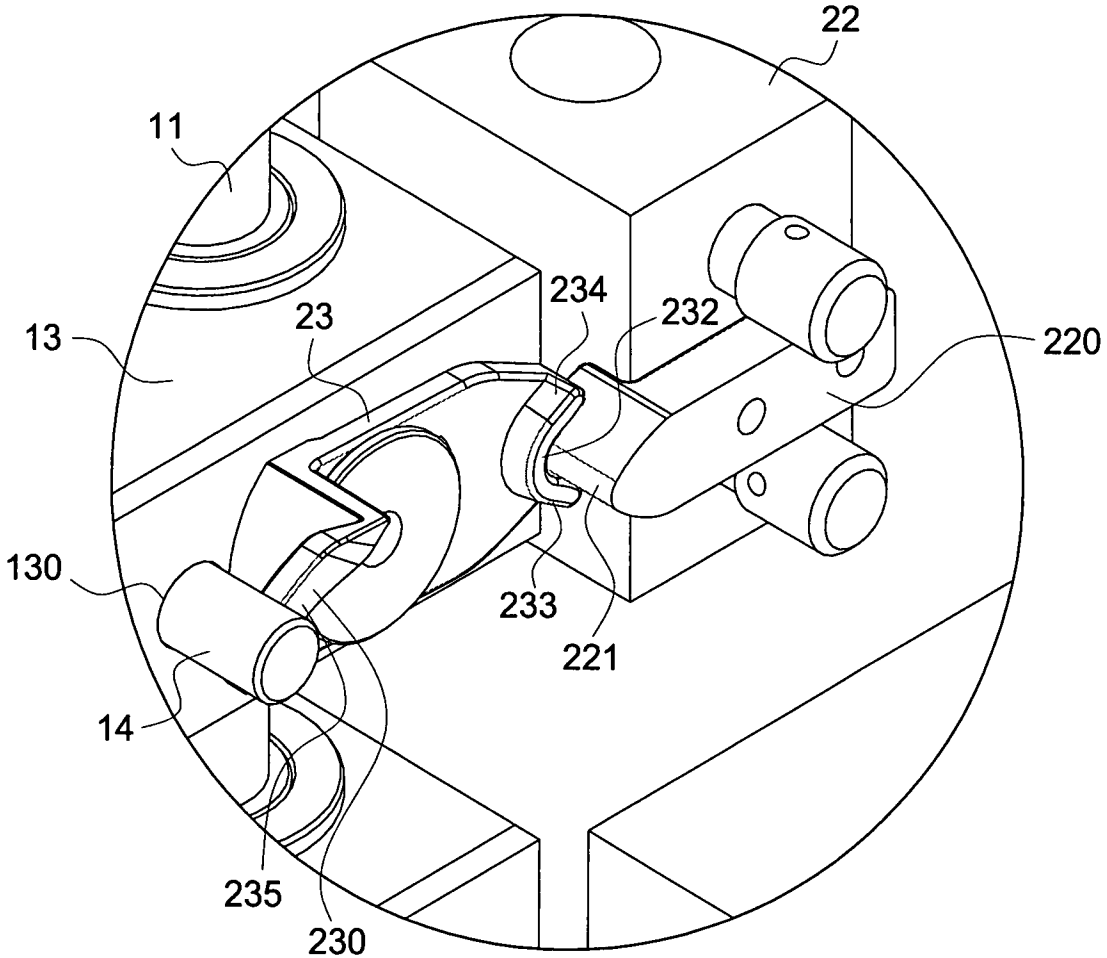
FIG. 14 is a partial perspective view to show the action between the weight device and the adjustment device in FIG. 12.

Referring to FIGS. 1 to 6, the adjustable weight assembly of the present invention comprises a weight device 10 and an adjustment device 20. The weight device 10 is connected to a base 30 and has at least one rail 11. A movable member 12 and multiple weights 13 are movably located on the rail 11. The movable member 12 is connected to a rod 120 and applied by a force from a force applying unit 40 of a weight training machine 50. The rod 120 has multiple through holes 121 defined therethrough. The user uses the force applying unit 40 to move the movable member 12 along the rail 11. Each weight 13 has a latitude hole 130 and a longitudinal hole 131 which communicates with the latitude hole 130. As shown in FIGS. 4 and 10, each latitude hole 130 has a pin 14 extending therethrough and the rod 120 extends through the longitudinal holes 131. The through holes 121 are located corresponding to the latitude holes 130. When the pin 14 is inserted into the through hole 121, the weight 13 is secured on the rod 120 (the locked status). As shown in FIGS. 6 and 8, when the pin 14 is removed from the through hole 121, the weight 13 is not secured on the rod 120 (the unlocked status) as shown in FIGS. 6 and 7.

As shown in FIGS. 1 to 6, the adjustable device 20 is connected to the base 320 and has a driving unit 21, a movable part 22 and multiple pivotal members 23. Each pivotal member 23 has a first portion 230 which is connected to the pin 14, and a second portion 231. The driving unit 21 comprises a guide rod 210 and a threaded rod 211. The movable part 22 is movably mounted to the guide rod 210 and connected to the threaded rod 211. The threaded rod 211 is rotated by a motor 212 so as to drive the movable part 22 along the guide rod 210, the threaded rod 211 and the at least one rail 11. The movable part 22 has a lever 220 which is located corresponding to the second portion 231. The driving unit 21 drives the movable part 22 along the at least one rail 11. When the movable part 22 moves toward the first end of the at least one rail 11, the lever 220 drives the second portion 231 so that the pivotal member 23 pivots from a first angle to a second angle. The pin 14 is then pushed by the pivotal member 23 and inserted into the through hole 121 so that the weight 13 is secured to the rod 120 (the locked status). When the movable part 22 moves toward the second end of the at least one rail 11, the lever 220 drives the second portion 231 so that the pivotal member 23 pivots from the second angle to the first angle, and the pin 14 is removed from the through hole 121 by the pivotal member 23. The weight 13 is not secured to the rod 120 (the unlocked status) as shown in FIGS. 6 and 7.

Figure 7:
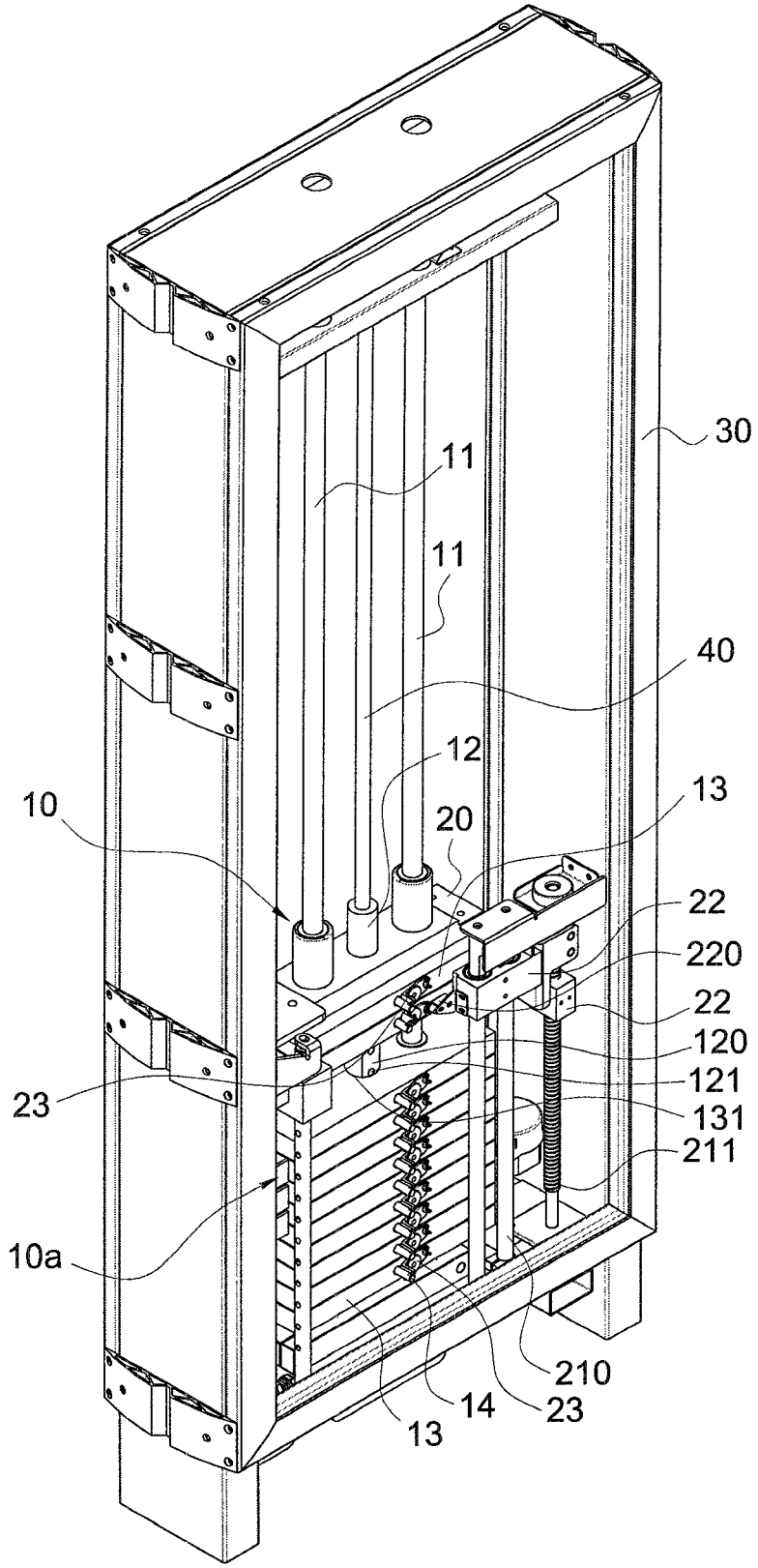
FIG. 7 is a perspective view to show that one large weight and one small weight of the adjustable weight assembly of the present invention are lifted.
Figure 8:
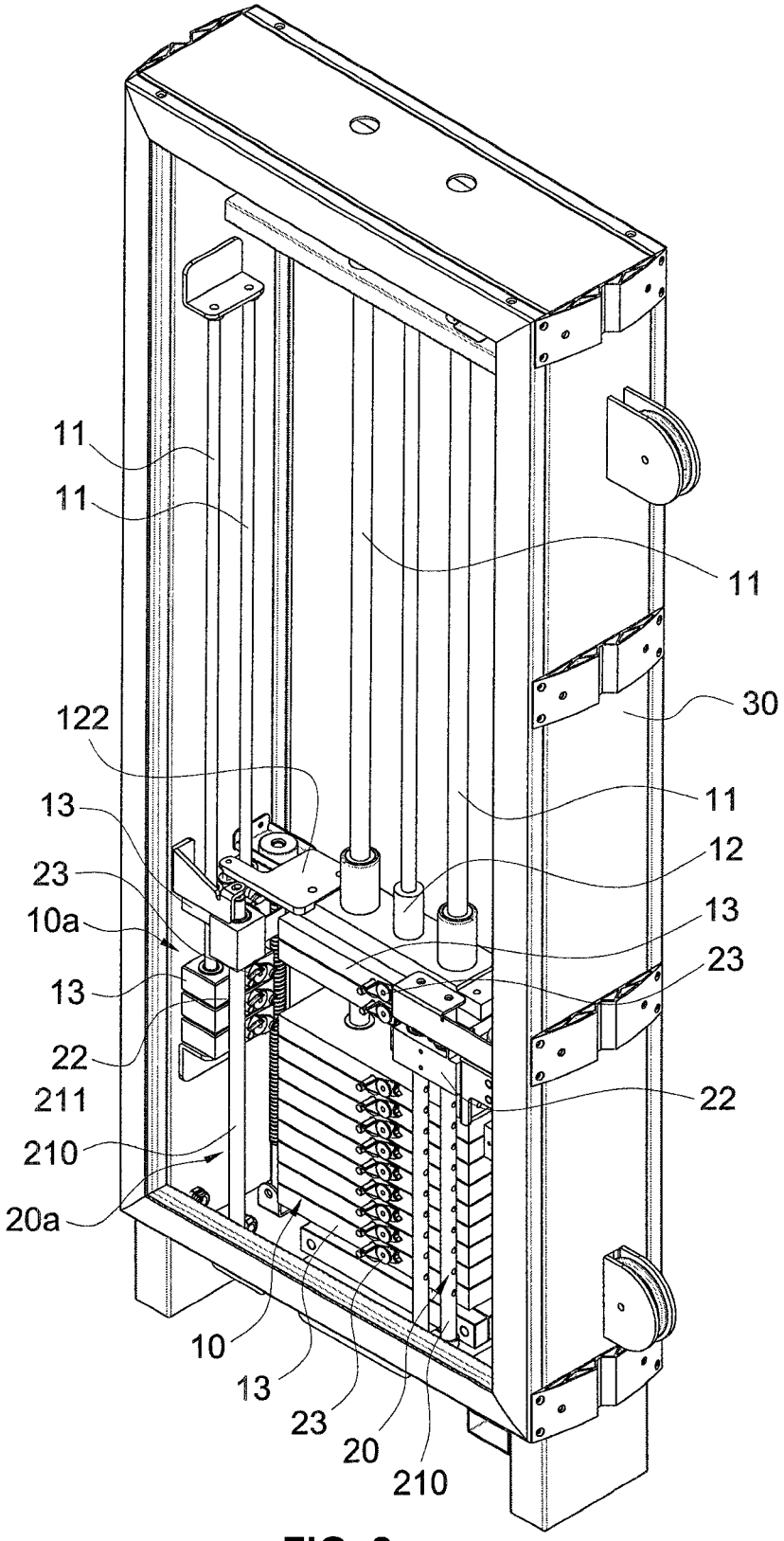
FIG. 8 is another view of the disclosure in FIG. 7.
Figure 9:
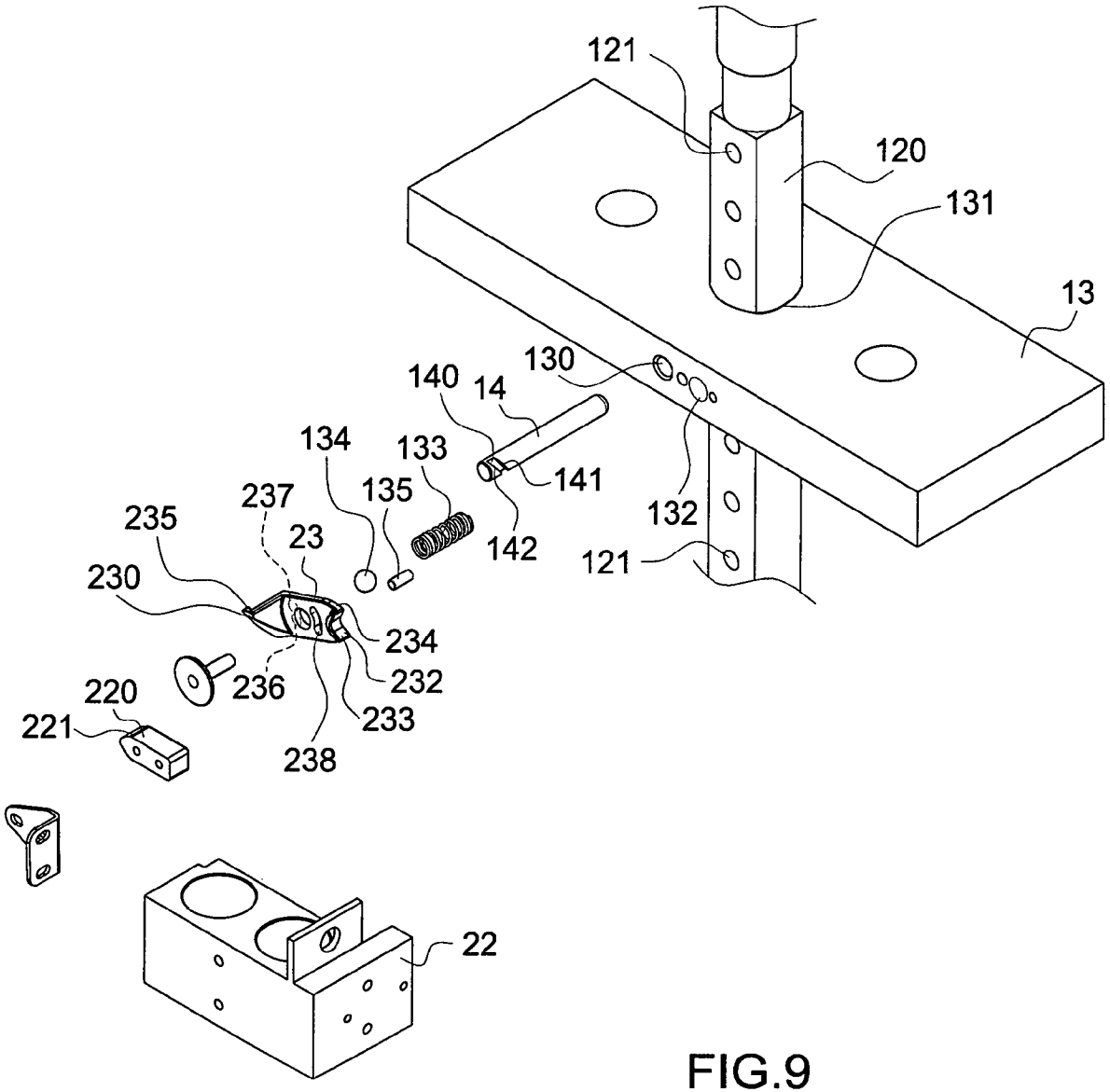
FIG. 9 is a partial exploded view to show the weight device and the adjustment device of the present invention.

As shown in FIGS. 6 to 8, the lever 220 is located on a side of the movable part 22. The lever 220 has a curved end 221 at a distal end thereof and the second portion 231 has a recess 232 which is located corresponding to the curved end 221. The recess 232 has a first protrusion 233 and a second protrusion 234 on two sides thereof. The first portion 230 is a spiral guide board 235. The axis of the spiral guide board 235 and the axis of the pivotal member 23 share the same one axis. The axis is parallel to the latitude hole 130. The pin 14 has a groove 140 defined in the periphery thereof and the groove 140 includes a first inside 141 and a second inside 142. The guide board 235 is engaged with the groove 140. When the movable part 22 moves toward the first end of the at least one rail 11, the lever 220 drives the first protrusion 233 so that the pivotal member 23 is rotated from the first angle to the second angle. The guide board 235 pushes the first inside 141 to insert the pin 14 through the through hole 121. When the movable part 22 moves toward the second end of the at least one rail 11, the lever 220 drives the second protrusion 234 so that the pivotal member 23 is rotated from the second angle to the first angle. The guide board 235 pushes the second inside 142 to remove the pin 14 from the through hole 121.

The pivotal member 23 has a first recessed portion 236 and a second recessed portion 237. Each of the weights 13 has a recess 132 which has a spring 133 and a bead 134 received therein. The bead 134 is biased by the spring 133 and partially protrudes from the weight 13. The bead 134 is located in the first and second recessed portions 236, 237 respectively to prevent the pivotal member 23 from rotating when the pivotal member 23 is located at the first and second angles respectively. The pivotal member 23 has a circular guide hole 238 and each weight 13 has a guide pin 135 which extends through the guide hole 238. The guide pin 135 is located at two distal ends of the guide hole 238 respectively to restrict the range that the pivotal member 23 pivots when the pivotal member 23 is located at the first and second angles respectively.

As shown in FIGS. 1 to 11, the second embodiment is disclosed, there are two weight devices 10, 10*a* and two adjustment devices 20, 20*a*. A connection member 122 is connected between the two respective movable members 12 of the two weight devices 10, 10*a*. The weight 13 of the weight device 10*a* is lighter than the weight 13 of the other weight device 10. For example, each weight 13 of the weight device 10 is 5 kg. Each weight 13 of the other weight device 10*a* is 1 kg. When the user wants to use load of 10 kg to train muscles, the control mode is first set, wherein the motor 212 is controlled to set the displacement of the movable part 22. The motor 212 of the weight device 10 drives the threaded rod 211 to rotate so that the movable part 22 is lowered to the position below the second weight 13 which weights 10 kg. During the movement, the lever 220 pivots the pivotal member 23 which makes the pin 14 insert in the through hole 121 of the rod 120 to secure two 5 kg weights 13 to the rod 120. The load is then set to 10 kg. When the user wants to set the load to be 11 kg, the motor 212 of the adjustment device 20 drives the threaded rod 211 to rotate so that the movable part 22 is lowered to the position below the second weight 13 which weights 10 kg. During the movement, the lever 220 pivots the pivotal member 23 which makes the pin 14 insert in the through hole 121 of the rod 120 to secure two 5 kg weights 13 to the rod 120. The motor 212 of the other adjustment 20 drives the threaded rod 211 to rotate so that the movable part 22 is lowered to the position below the second weight 13 which weights 1 kg. During the movement, the lever 220 pivots the pivotal member 23 which makes the pin 14 insert in the through hole 121 of the rod 120 to secure one 1 kg weight 13 to the rod 120. Therefore, a total 11 kg load arranged by the weights 13 is set.

The cooperation of the weight device 10 and the adjustment unit 20 can adjust the weight easily. There are different weights 13 available for adjustment of the total weight and the lighter weights 13 are used to set desired load when training.

While we have shown and described the embodiment in accordance with the present invention, it should be clear to those skilled in the art that further embodiments may be made without departing from the scope of the present invention.

What is claimed is:

1. An adjustable weight assembly comprising:

a weight device connected to a base and having at least one rail, a movable member and multiple weights, the movable member connected to a rod and being applied by a force from a force applying unit so as to move along the at least one rail, the rod having multiple through holes defined therethrough and each weight having a latitude hole and a longitudinal hole which communicates with the latitude hole, each latitude hole having a pin extending therethrough, the rod extending through the longitudinal holes, the through holes located corresponding to the latitude holes, and at least one adjustable device having a driving unit, a movable part and multiple pivotal members, the driving unit driving the movable part along the at least one rail, the movable part having a lever, each weight pivotably connected to one of the pivotal members and each pivotal member having a first portion and a second portion, when the movable part moves toward a first end of the at least one rail, the lever driving the second portion so that the pivotal member pivots from a first angle to a second angle, the pin being pushed by the pivotal member and inserted into the through hole, when the movable part moves toward a second end of the at least one rail, the lever driving the second portion so that the pivotal member pivots from the second angle to the first angle, the pin being removed from the through hole by the pivotal member.

2. The assembly as claimed in claim 1, wherein the lever has a curved end at a distal end thereof and the second portion has a recess which is located corresponding to the curved end, the recess has a first protrusion and a second protrusion on two sides thereof, the first portion is a spiral guide board, the pin has a groove defined in a periphery thereof and the groove includes a first inside and a second inside, the guide board is engaged with the groove, when the movable part moves toward a first end of the at least one rail, the lever drives the first protrusion so that the pivotal member is rotated from the first angle to the second angle, the guide board pushes the first inside to insert the pin through the through hole, when the movable part moves toward the second end of the at least one rail, the lever drives the second protrusion so that the pivotal member is rotated from the second angle to the first angle, the guide board pushes the second inside to remove the pin from the through hole.

3. The assembly as claimed in claim 1, wherein the pivotal member has a first recessed portion and a second recessed portion, each of the weights has a recess which has a spring and a bead received therein, the bead is biased by the spring and partially protrudes from the weight, the bead is located in the first and second recessed portions respectively when the pivotal member is located at the first and second angles respectively.

4. The assembly as claimed in claim 1, wherein the pivotal member has a circular guide hole and each weight has a guide pin which extends through the guide hole, the guide pin is located at two distal ends of the guide hole respectively when the pivotal member is located at the first and second angles respectively.

5. The assembly as claimed in claim 1, wherein the driving unit comprises a guide rod and a threaded rod, the movable part is movably mounted to the guide rod and connected to the threaded rod, the threaded rod is rotated by a motor so as to drive the movable part along the guide rod, the threaded rod and the at least one rail.

6. The assembly as claimed in claim 1, wherein there are two weight devices and two adjustment devices, a connection member is connected between the two respective movable members of the two weight devices.

7. The assembly as claimed in claim 6, wherein the weight of the weight device is lighter than the weight of the other weight device.

8. The assembly as claimed in claim 6, wherein the lever has a curved end at a distal end thereof and the second portion has a recess which is located corresponding to the curved end, the recess has a first protrusion and a second protrusion on two sides thereof, the first portion is a spiral guide board, the pin has a groove defined in a periphery thereof, when the movable part moves toward a first end of the at least one rail, the lever drives the first protrusion so that the pivotal member is rotated from the first angle to the second angle, the guide board pushes the first inside to insert the pin through the through hole, when the movable part moves toward the second end of the at least one rail, the lever drives the second protrusion so that the pivotal member is rotated from the second angle to the first angle, the guide board pushes the second inside to remove the pin from the through hole.

9. The assembly as claimed in claim 6, wherein the pivotal member has a first recessed portion and a second recessed portion, each of the weights has a recess which has a spring and a bead received therein, the bead is biased by the spring and partially protrudes from the weight, the bead is located in the first and second recessed portions respectively when the pivotal member is located at the first and second angles respectively.

10. The assembly as claimed in claim 6, wherein the pivotal member has a circular guide hole and each weight has a guide pin which extends through the guide hole, the guide pin is located at two distal ends of the guide hole respectively when the pivotal member is located at the first and second angles respectively.

11. The assembly as claimed in claim 6, wherein the driving unit comprises a guide rod and a threaded rod, the movable part is movably mounted to the guide rod and connected to the threaded rod, the threaded rod is rotated by a motor so as to drive the movable part along the guide rod, the threaded rod and the at least one rail.

* * * * *